US005527099A

United States Patent [19]

Fikse

[11] Patent Number: 5,527,099

[45] Date of Patent: Jun. 18, 1996

[54] TUNNEL BORING MACHINE ANCHOR SHOE STRUCTURE AND PROCESS OF OPERATING A TUNNEL BORING MACHINE HAVING SUCH ANCHOR SHOE STRUCTURE

[76] Inventor: Tyman H. Fikse, P.O. Box 1008, La Conner, Wash. 98257

[21] Appl. No.: 239,479

[22] Filed: May 9, 1994

[51] Int. Cl.[6] ..... E21C 29/02; E21D 9/10

[52] U.S. Cl. ..... 299/31; 299/33; 405/142

[58] Field of Search ..... 299/31, 33, 56, 299/58; 405/138, 141, 142

[56] References Cited

U.S. PATENT DOCUMENTS

| | | | |
|---|---|---|---|
| 4,420,188 | 12/1983 | Robbins et al. | 299/31 |
| 4,548,443 | 10/1985 | Turner | 299/31 |
| 4,915,453 | 4/1990 | Fikse | 299/31 |
| 5,005,911 | 4/1991 | Fikse | 299/31 |
| 5,205,613 | 4/1993 | Brown, Jr. | 299/33 X |

FOREIGN PATENT DOCUMENTS

| | | | |
|---|---|---|---|
| 2252308 | 7/1973 | Germany | 299/31 |
| 2520915 | 11/1976 | Germany | 405/141 |

*Primary Examiner*—David J. Bagnell
*Attorney, Agent, or Firm*—Robert W. Beach

[57] ABSTRACT

The anchor shoes of a tunnel-boring machine arranged in a circular configuration are individually truncated by being tapered rearwardly so that the girth of the circular anchor shoe configuration can decrease progressively in order to accommodate convergence of superincumbent ground pressure. Preferably the anchor shoes are mounted for tilting of their aft portions to enable the degree of convergence or constriction to be altered. Chordal jacks connecting adjacent anchor shoes exert pressure on them resisting inward swinging of the aft portions of the anchor shoes resulting from superincumbent ground pressure.

36 Claims, 11 Drawing Sheets

TUNNEL BORING MACHINE ANCHOR SHOE STRUCTURE AND PROCESS OF OPERATING A TUNNEL BORING MACHINE HAVING SUCH ANCHOR SHOE STRUCTURE

BACKGROUND OF THE INVENTION

1. Field of the Invention

This invention relates to tunnel-boring machines having rotary cutterheads and particularly to the anchoring system for such a machine including anchor shoes engageable with the tunnel wall aft of the rotary cutterhead.

2. Prior Art

Tunnel-boring machines utilizing rotary cutterheads in general are known, examples of such machines being shown particularly in FIGS. 15 and 16 of Robbins et al. U.S. Pat. No. 4,420,188, issued Dec. 13, 1983, and FIG. 1 of Turner U.S. Pat. No. 4,548,443, issued Oct. 22, 1985. The most similar machine is shown in Fikse U.S. Pat. No. 4,915,453, issued Apr. 10, 1990 and U.S. Pat. No. 5,005,911, issued Apr. 9, 1991. None of these machines, however, has an anchor shoe system of the type to which the present invention relates.

SUMMARY OF THE INVENTION

A principal object of the present invention is to provide an anchor shoe arrangement for a tunnel-boring machine which can be adjusted somewhat to accommodate superincumbent ground pressure produced by crumbling or fracturing rock settling following penetration of the cutterhead of the tunnel-boring machine.

A more specific object is to provide an anchor shoe arrangement of generally circular configuration which can yield to provide a more constricted configuration and especially an anchor shoe arrangement which tapers to some extent from fore to aft.

A further object is in a shuffling anchor shoe type of tunnel-boring machine to increase the ground support during relocation of the anchor shoes in advancing the machine.

Another object is to substantially equalize the ground load on anchor shoes of a tunnel-boring machine arranged in a generally circular configuration.

It is also an object to provide more efficient structure for the tunnel-boring machine by using smaller components and fewer parts so that the operating mechanism is lighter and more compact fore and aft than previous mechanism used in machines for boring tunnels of comparable size.

More specifically, it is an object to make the interior of the tunnel-boring machine less cluttered and especially to provide a more open central portion of the machine.

The foregoing objects can be accomplished by providing a tunnel-boring machine having truncated anchor shoes arranged in a generally circular configuration, the edge portions of which anchor shoes are relieved from fore to aft so that the anchor shoes are tapered rearwardly, and mounting the anchor shoes for tilting relative to the cutterhead about fulcrums near their forward ends so that the rear portions of the anchor shoes can swing inward to provide a progressively smaller girth rearwardly for the generally circular anchor shoe configuration.

In operation a pushing force can be applied to alternate anchor shoes in the generally circular configuration for setting such shoes more firmly and a pulling force can be applied simultaneously to the other alternate anchor shoes to relieve their outward ground pressure somewhat. Such pushing force has a forward vector component for pushing the rotary cutterhead forward and the pulling force also has a horizontal vector component for sliding such shoes forward relative to the shoes to which the pushing force is applied. While such pushing and pulling forces are supplied simultaneously pressure is also applied to all the anchor shoes in the anchor shoe configuration for resisting ground pressure.

DETAILED DESCRIPTION

As stated above, my previous U.S. Pat. No. 4,915,453 shows a tunnel-boring machine most similar to the present machine which incorporates improvements over the machine shown in said U.S. patent. Because of the generally similar character of these tunnel-boring machines, however, aspects of the tunnel-boring machine construction which do not have a bearing on the present invention will not be described in detail, but reference is made to my aforesaid previous patent for disclosure of such aspects of the machine, and that previous patent is hereby incorporated by reference in the present specification.

Figure 1:
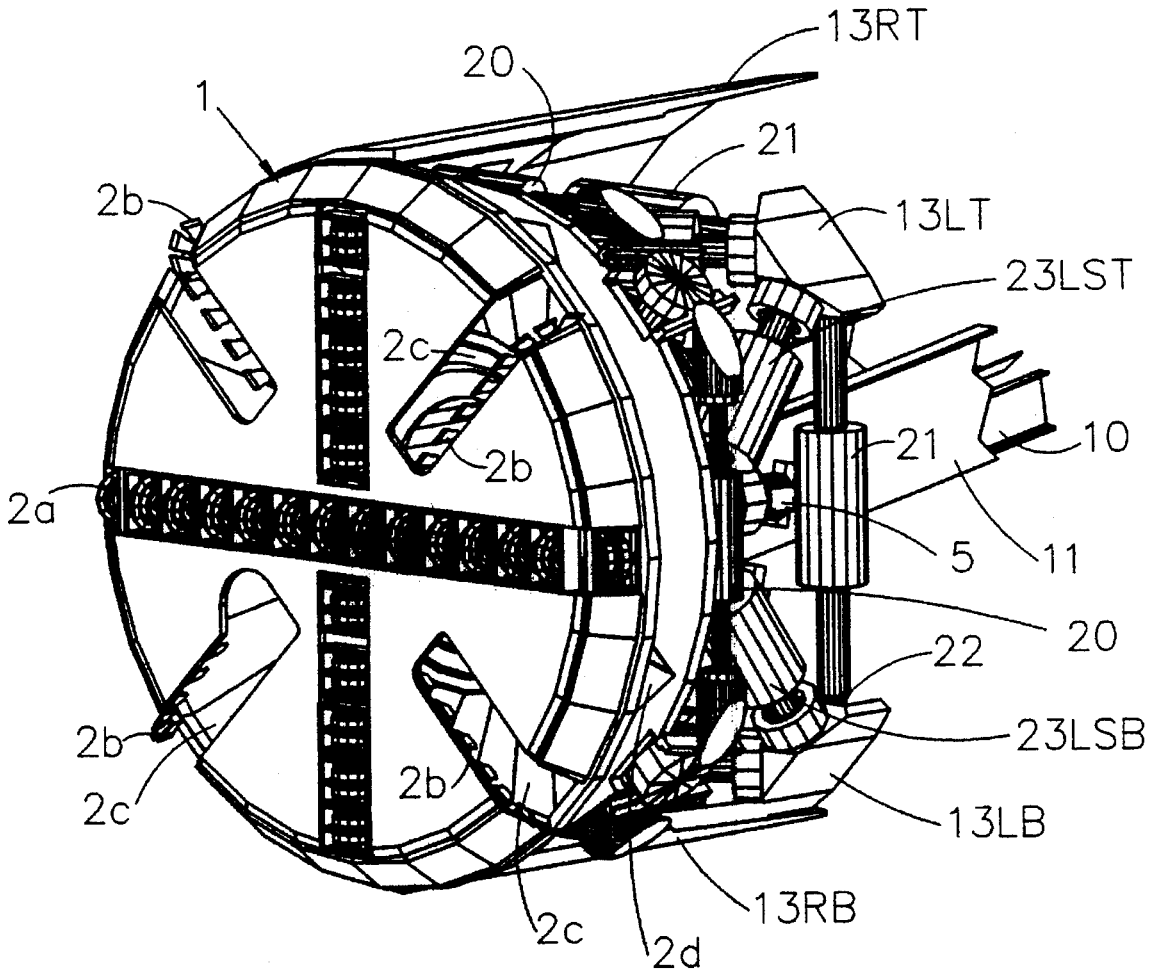
FIG. 1 is a diagrammatic top perspective of the forward portion of the tunnel-boring machine with parts broken away.

The tunnel-boring machine includes a forward rotary cutterhead 1 which carries rotatable cutters 2*a* that are not power-rotated, preferably arranged in radial rows as shown in FIG. 1. Such rotatable cutters crush rock at the face of the tunnel bore as the cutterhead is rotated while being pressed forward. The cutterhead also carries scraper blades 2*b*, preferably arranged in radial rows along the trailing edges of radial discharge slots 2*c* through the cutterhead. Buckets 2*d* are mounted on the inner or back side of the cutterhead to pick up debris passing inward through the gap between the cutterhead and the portion of the machine immediately behind it.

As the cutterhead 1 is rotated, the cutters 2*a* will fracture and crush rock at the tunnel face by pressure against it, and the scraping teeth 2*b* will scrape the resulting debris from the tunnel face to pass through the slots 2*c*.

Figure 2:
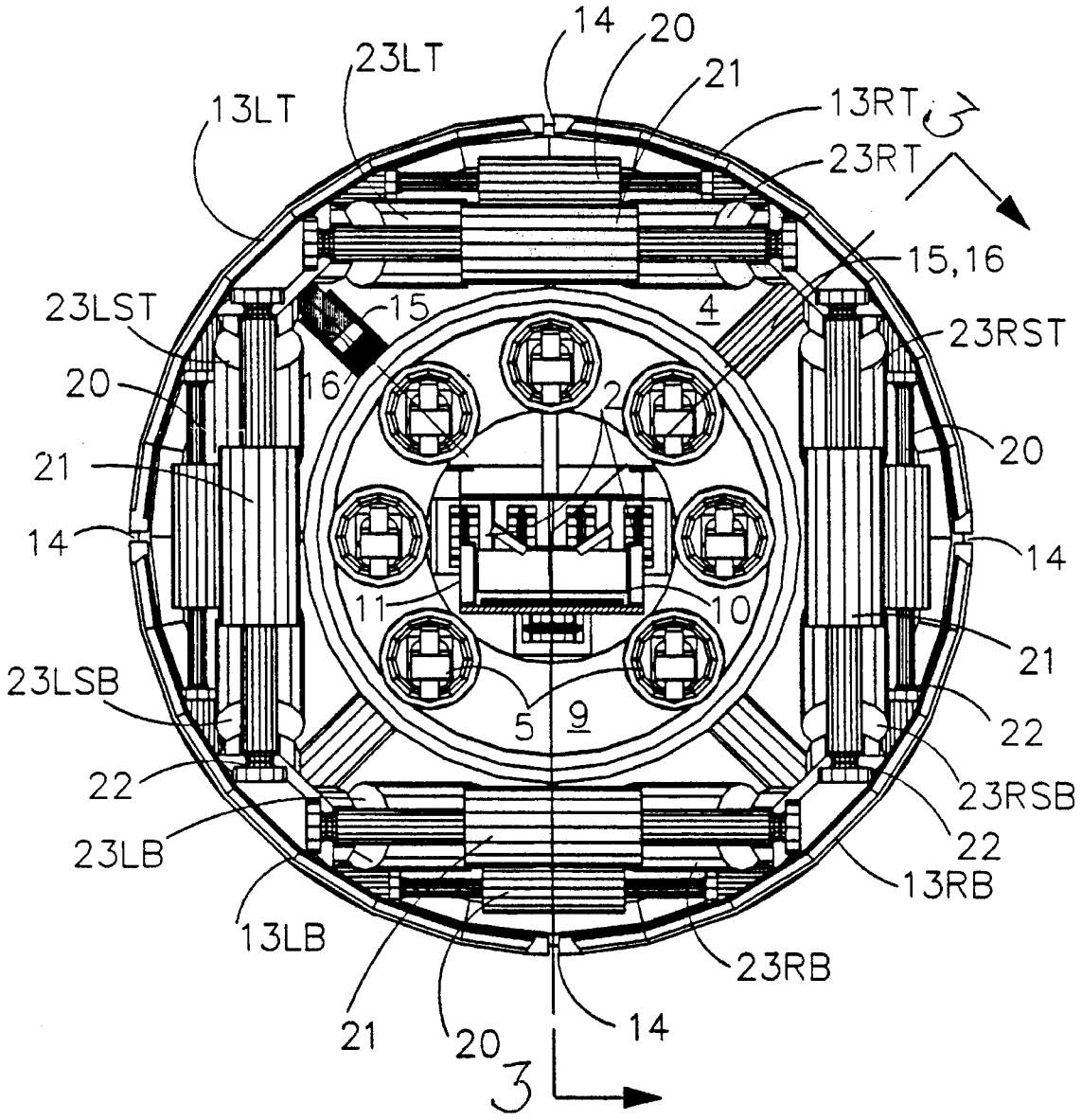
FIG. 2 is a transverse section through the tunnel-boring machine looking forward.
Figure 3:
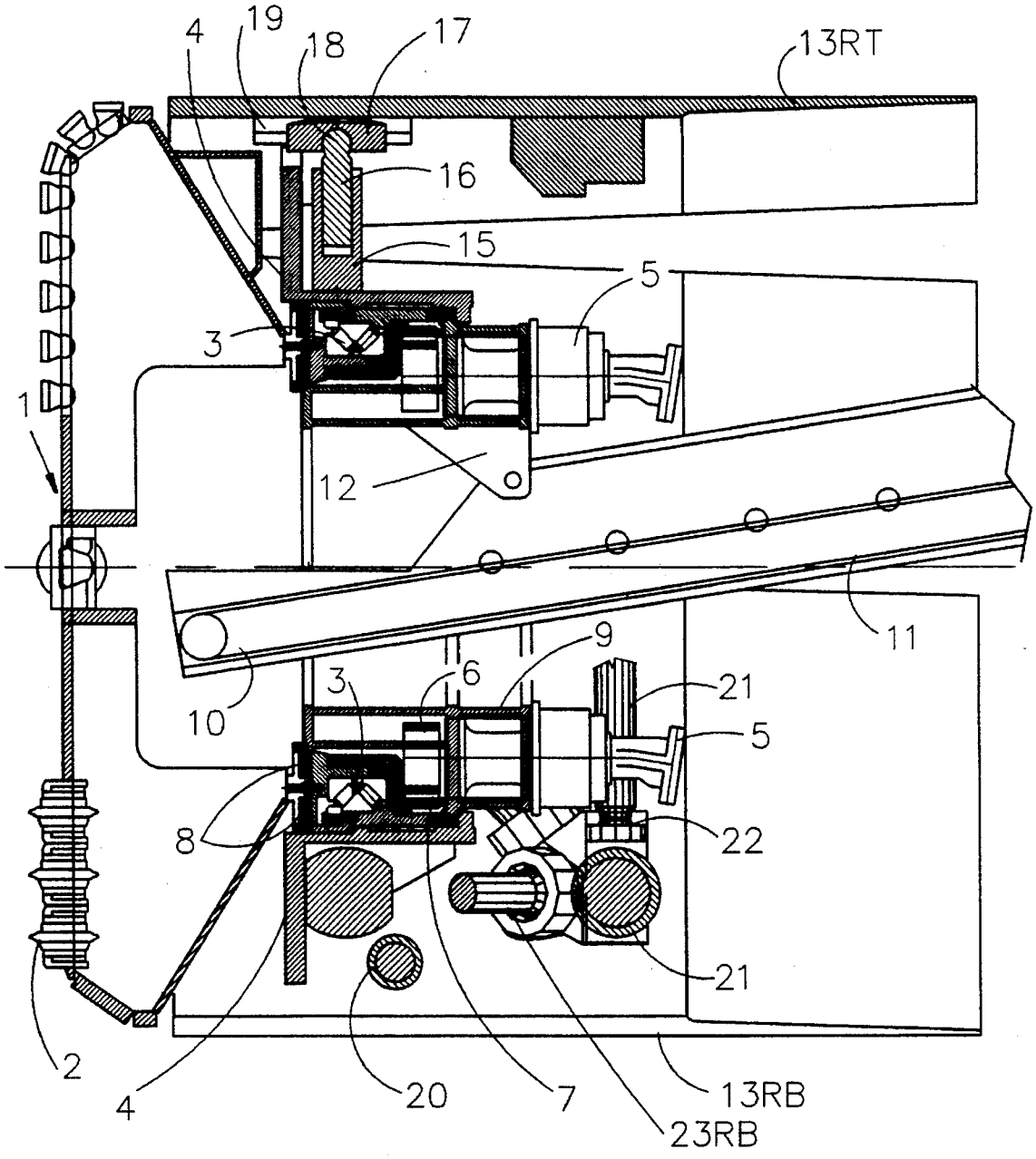
FIG. 3 is a longitudinal section through the forward portion of the tunnel-boring machine taken on line 3—3 of FIG. 2 with parts broken away.

The rotary cutterhead 1 is mounted by combined radial and thrust bearings 3 carried by an outer nonrotative mounting ring 4 of angular cross section forming a forward radial ring disk flange and a cylindrical inner flange extending rearward from the inner periphery of the radial ring disk flange as shown in FIG. 3. The cutterhead can be rotated relative to the mounting ring 4 by hydraulic motors 5 arranged in a circle as shown in FIG. 2 which drive pinions 6 meshing with an internal ring gear 7 carried by the cutterhead. Ring seals 8 seal the joints between the rotary cutterhead and the nonrotative outer mounting ring 4 and inner mounting ring 9 concentric with the outer mounting ring. The motors 5 are mounted between the inner ring 9 and the inner cylindrical flange of the cutterhead mounting ring 4.

The forward end of a muck conveyor 10 for removing debris from the tunneling operation extends forward from the aft portion of the tunnel-boring machine through the inner mounting ring 9 to a location in the hollow rotary cutterhead adjacent to the cutter structure as shown in FIG. 3. Such muck conveyor is carried by a tow beam 11 connected by a bracket 12 to the nonrotative inner cutterhead mounting ring structure 9 so that the muck conveyor will be moved forwardly in conjunction with forward movement of the cutterhead and its mounting rings 4 and 9 during a boring operation. Debris will be dumped from the rotating cutterhead into the muck conveyor.

The internal mechanism of the tunnel-boring machine immediately aft of the cutterhead is shielded from the enveloping ground by several anchor shoes arranged in a generally circular configuration. Four of these anchor shoes are shown in the drawings, each anchor shoe having a cylindrically arcuate circumferential extent of approximately a quadrant, but three or more anchor shoes could be provided, preferably of substantially equal circumferentially arcuate extent. As shown in FIG. 2, the four anchor shoes are arranged two above and two beneath the cutterhead mounting ring 4 so that the slots between the anchor shoes are located at the top and bottom and at opposite sides of the forward portion of the tunnel-boring machine. The superincumbent ground pressure will be exerted approximately equally on all four anchor shoes, although the pressure on the lower two anchor shoes will be somewhat greater than the pressure on the upper two anchor shoes because of the weight of the tunnel-boring machine carried by them.

Looking forward, the upper right anchor shoe is designated 13RT, the upper left anchor shoe is designated 13LT, the lower right anchor shoe is designated 13RB, and the lower left anchor shoe is designated 13LB. The fore-and-aft slots between the adjacent edges of adjacent anchor shoes are designated 14.

When working deep underground, the superincumbent ground pressure is very great, causing convergence or constriction of the tunnel immediately aft of the rotary cutterhead, resulting from disturbance of the ground equilibrium effected by penetration of the cutterhead. It is extremely difficult to prevent crumbling or fracturing rock from settling inward until a new state of repose is achieved. The tunnel-boring machine of the present invention is constructed to enable the girth of the generally circular configuration of the anchor shoes aft of the rotary cutterhead to be reduced to accommodate constriction of the tunnel being bored to an extent sufficient to relieve somewhat the superincumbent ground pressure during settling of the ground to a new state of repose. Preferably the girth of the generally circular configuration of the anchor shoes decreases progressively aft of the rotary cutterhead.

While the generally circular configuration of the anchor shoes could simply be set to taper rearwardly to a desired degree, it is preferred that the girth of the generally circular anchor shoe configuration be adjustable so that the degree of rearward taper or convergence of the generally circular configuration of the anchor shoes can be altered as desired, depending upon the magnitude of the superincumbent ground pressure.

To enable the girth of the generally circular anchor shoe configuration to decrease progressively aft, although the individual shoes are cylindrically arcuate, the anchor shoes are truncated by their fore-and-aft edges being relieved increasingly aft, resulting in each shoe being tapered aft. The anchor shoes can then be arranged in rearwardly tilted relationship so that the width of the slots between the anchor shoes is uniform or the fore-and-aft edges of the adjacent anchor shoes can actually be in contact. In either case, the girth of the generally circular anchor shoe configuration will decrease progressively rearward.

During tunneling even at a predetermined depth, the superincumbent ground pressure may vary. Also, the present machine may be utilized to bore tunnels at different depths where the superincumbent ground pressure will be different. Consequently, it is desirable for the anchor shoes to be adjustable to alter the girth of the anchor shoe configuration. Such adjustability can be provided by the anchor shoes being tiltable fore-and-aft rather than having only a constant degree of tilt or convergence aft.

When the anchor shoes of cylindrically arcuate shape are arranged in a circular configuration which has a constant girth fore-and-aft, the intershoe slots 14 will flare rearwardly. By mounting the anchor shoes for tilting fore-and-aft the aft portions of the anchor shoes can be swung inward until the adjacent fore-and-aft edges of adjacent anchor shoes are actually in contact to enable circumferential forces to be transmitted directly between adjacent anchor shoes.

Figure 4:
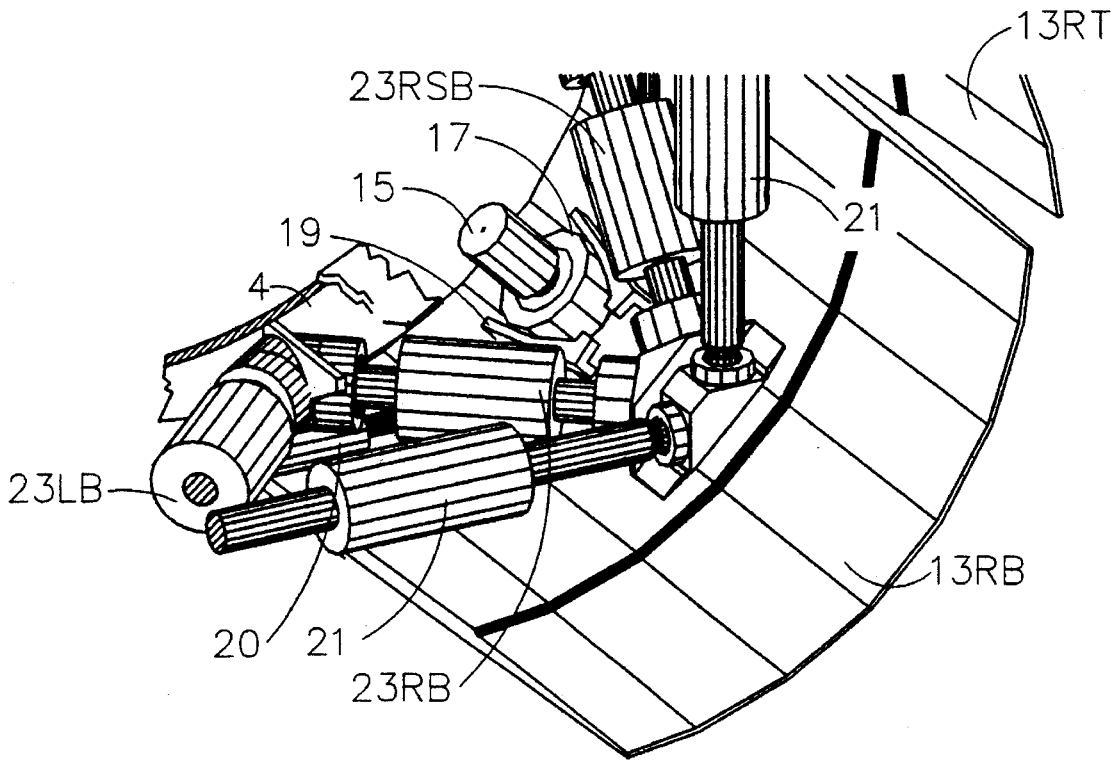
FIGS. 4 and 5 are enlarged detail top perspectives of an interior portion of the tunnel-boring machine showing parts in different operative positions.
Figure 5:
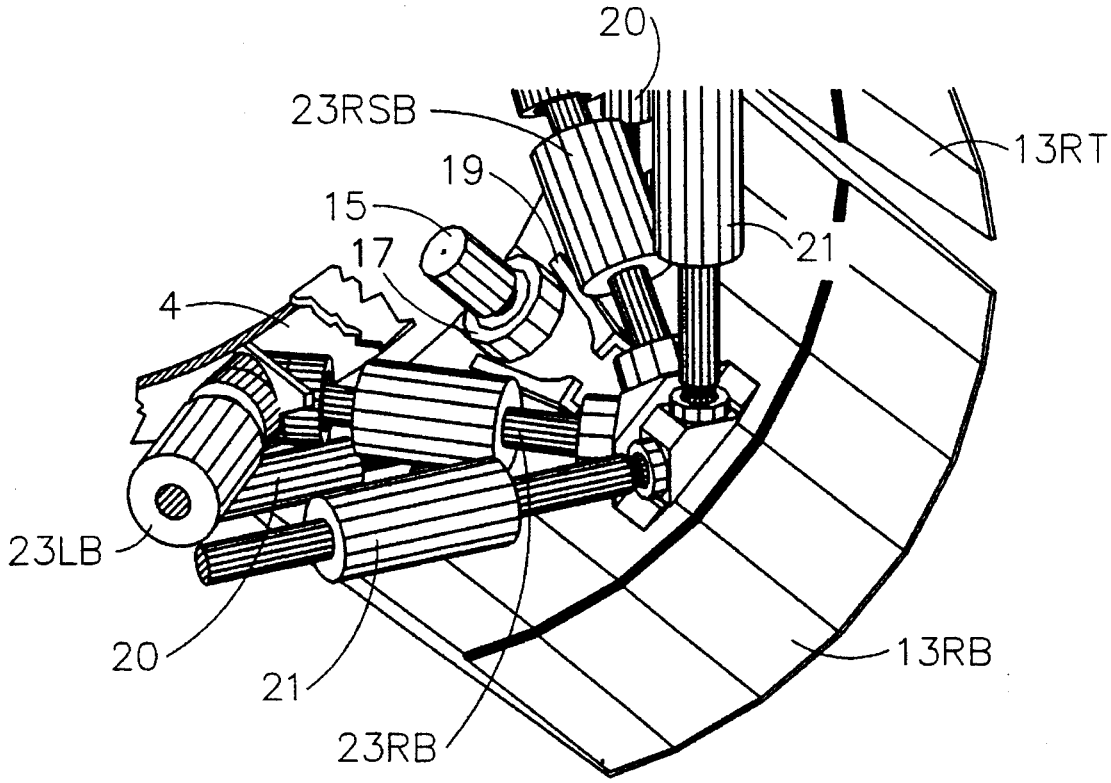

To enable desired tilting of the anchor shoes relative to the cutterhead 1, supporting means for the tunnel-boring machine at the fore portion of each anchor shoe provide a fulcrum about which the aft portion of such anchor shoe can swing. As shown in FIGS. 3, 4 and 5, such a fulcrum can be composed of a hydraulic jack including a short cylinder 15 mounted on the nonrotative cutterhead supporting ring 4 and a short piston 16 received in such cylinder, which piston and cylinder are relatively movable radially. On the piston 16 is mounted a pressure-transmitting fulcrum or foot 17 by a ball joint 18 so that the fulcrum can tilt relative to the piston 16. The fulcrum 17 is crowned so as to fit the concave inner side of the contacting anchor shoe irrespective of the relatively rotated position of the fulcrum head with respect to the cutterhead mounting ring 4 and anchor shoe.

Figure 6:
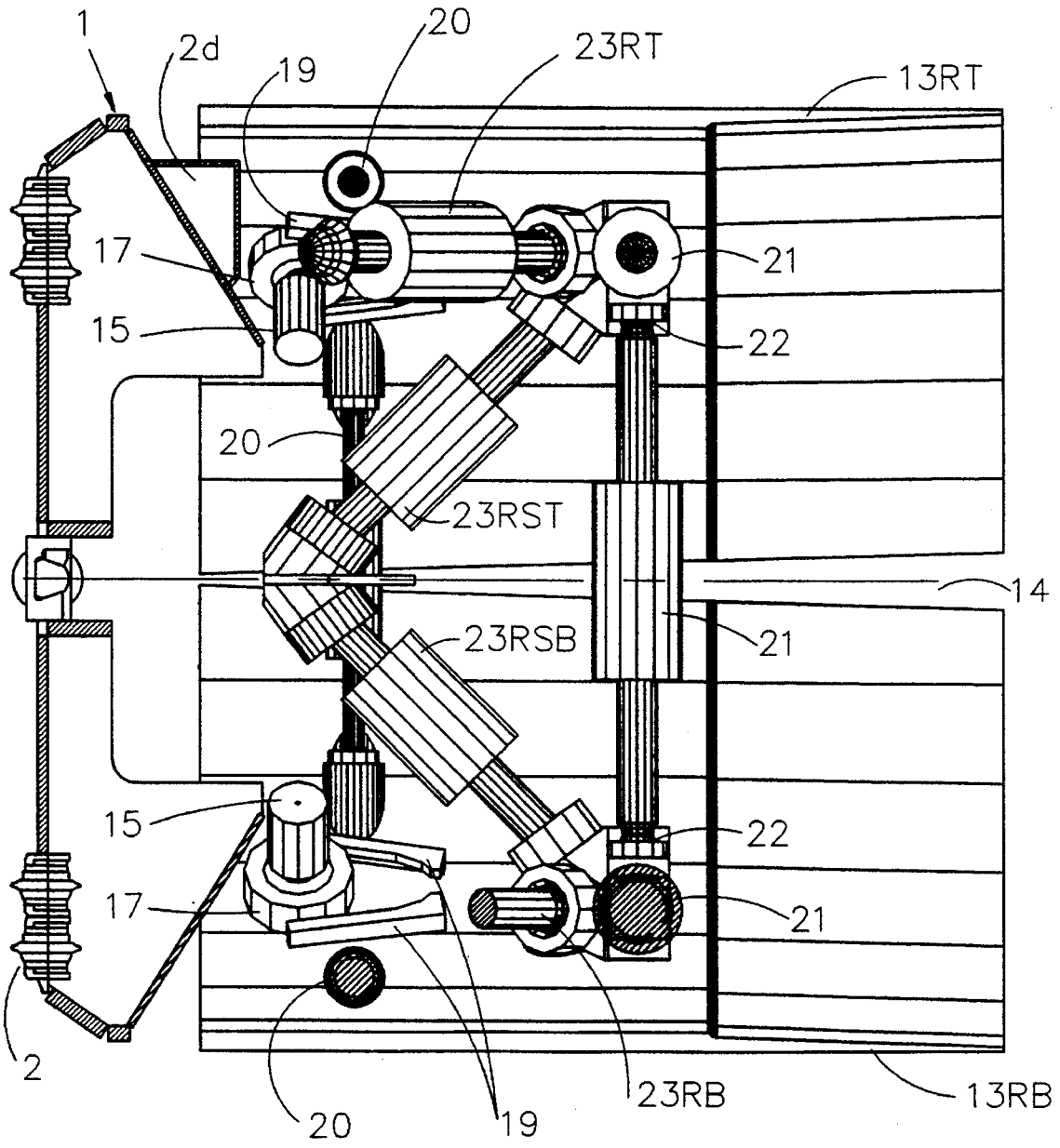
FIG. 6 is a longitudinal vertical section through the forward portion of the tunnel-boring machine with parts broken away to show some of the components in greater detail.
Figure 7:
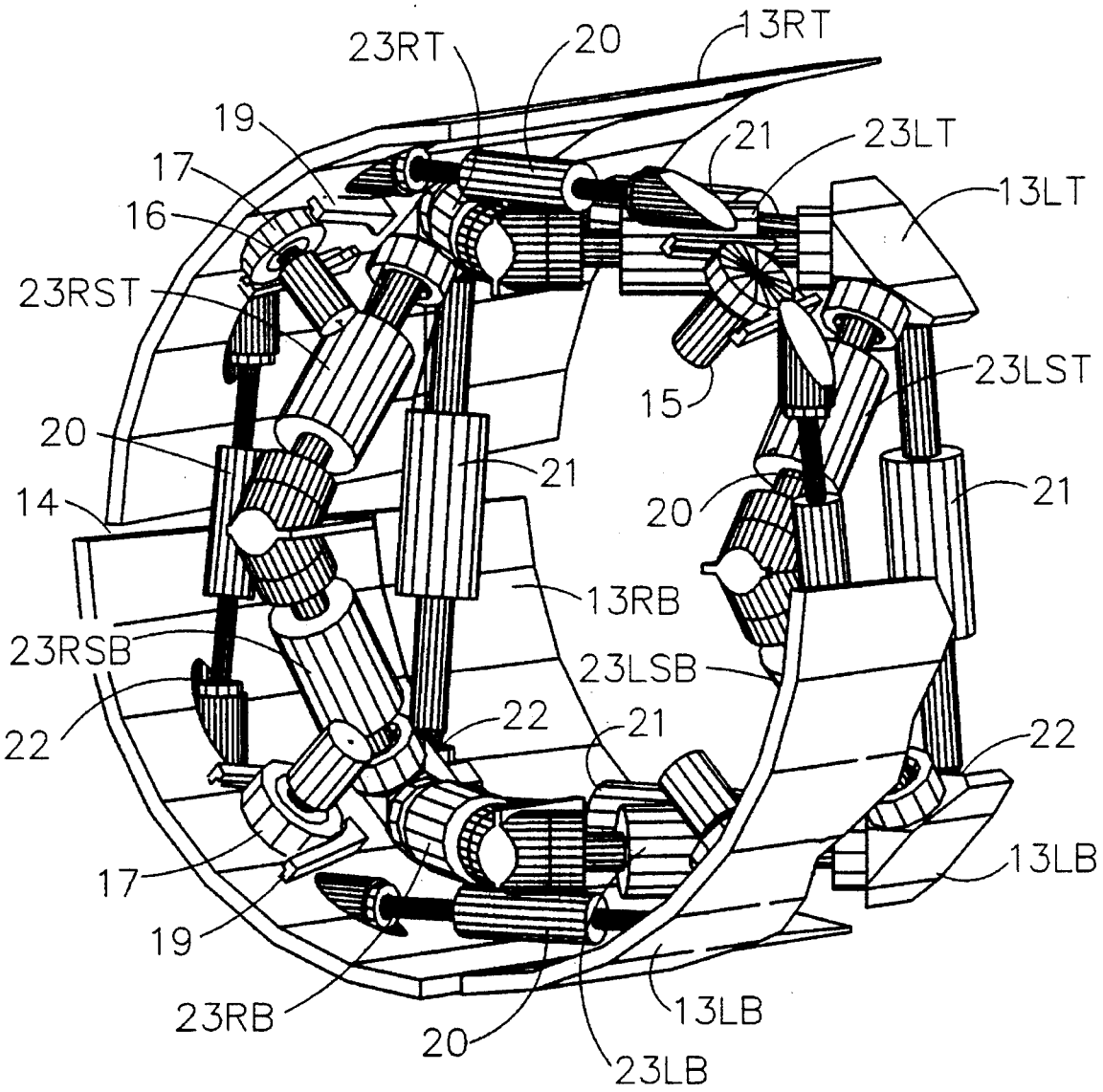
FIG. 7 is a front perspective of the forward portion of the tunnel-boring machine with parts broken away to show internal structure.

The fulcrum cylinders 15 are mounted on the cutterhead mounting ring 4 spaced apart circumferentially 90 degrees, the upper and lower right positions being shown in FIGS. 6 and 7, and the other two fulcrum cylinders not shown in these figures are located in the upper and lower left positions. It is intended that each fulcrum engage approximately the circumferential center of an anchor shoe but, in order to avoid the production of localized stresses between interconnected parts, it is also preferred that each anchor shoe simply bear against its fulcrum 17 rather than being secured to its fulcrum so that, the anchor shoe and the fulcrum will be relatively slidable both circumferentially and fore-and-aft. The upper two hydraulic jacks 15, 16 and their fulcrums 17 support the forward portions of the upper shoes 13LT and 13RT from the cutterhead mounting ring 4 on which such jacks are mounted and the lower two hydraulic jacks 15, 16 support the cutterhead mounting ring 4 carrying them on the forward portions of the lower anchor shoes 13LB and 13RB to which weight of the cutterhead, cutterhead mounting ring, and associated parts including motors 5 and inner cutterhead mounting ring 9 is transmitted through the fulcrums 17 serving as feet.

In order to center the forward portion of each anchor shoe relative to its foot or fulcrum 17, forwardly divergent guide rails 19 are mounted on the inner side of each anchor shoe in positions straddling the radial projection formed by the foot or fulcrum 17 and its mounting piston 16 and cylinder 15. When the anchor shoe is slid forward relative to the cutterhead mounting ring 4 and its supporting foot 17 from the position shown in FIG. 5 toward the cutterhead, the adjacent edges of the guide rails will contact the edges of the foot or fulcrum as shown in FIG. 4 to shift the forward portion of the anchor shoe circumferentially as necessary to center the foot or fulcrum on the forward portion of the anchor shoe. The rear portion of the anchor shoe is centered by the pulling force applied to it as described hereinafter.

To prevent the forward ends of the upper anchor shoes in the generally circular configuration substantially bearing on the fulcrums 17 from being pushed outward too far by the jacks 15, 16, circumferential separation of the forward ends of the anchor shoes is restricted by forward intershoe jacks 20 bridging the slots 14 between adjacent anchor shoes and secured to such anchor shoes at approximately the fore-and-aft location of the fulcrums 17, providing chordal ties. While such ties may be of chain or cable or of other material capable of withstanding reasonable tensile stress, utilization of hydraulic jacks is preferred.

If the anchor shoes are to be adjustable by being tiltable fore-and-aft rather than simply being positioned with the adjacent edges of adjacent anchor shoes in abutment, it is necessary to be able to control the tilting of such anchor shoes. In addition to controlling the tilting of the anchor shoes about the fulcrums 17, it is also important to be able to exert pressure on the anchor shoes for resisting contraction of the generally circular anchor shoe configuration resulting from superincumbent ground pressure acting on them.

Figure 11:
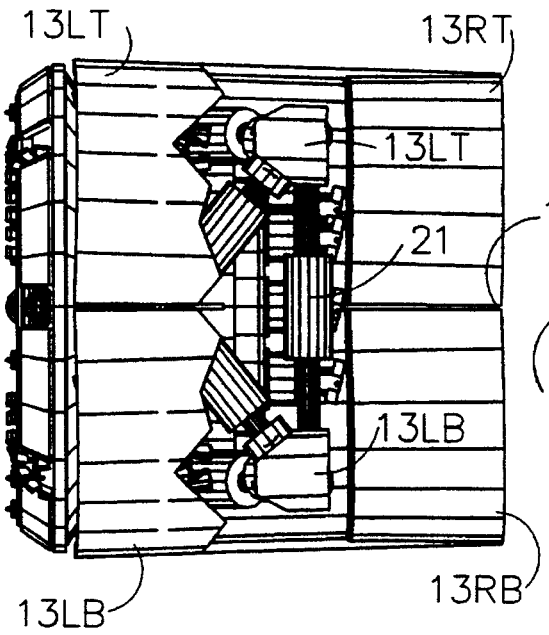
FIG. 11 is side elevation of the forward portion of the tunnel-boring machine having parts broken away and having parts shown in an operative position different from that shown in FIGS. 8, 9 and 10.
Figure 12:
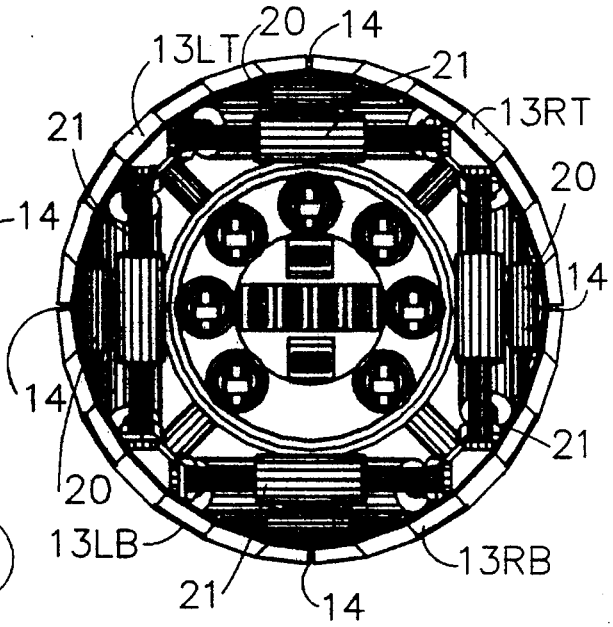
FIG. 12 is a rear elevation of the forward portion of the tunnel-boring machine showing parts in the same position as shown in FIG. 11.
Figure 13:
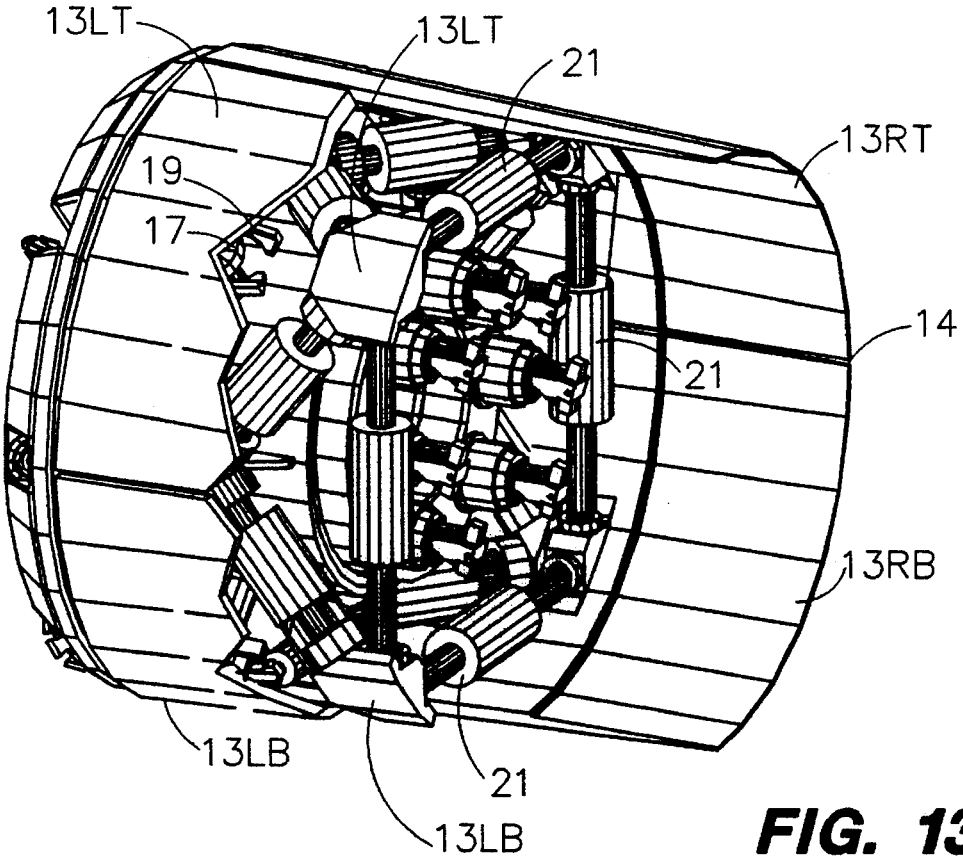
FIG. 13 is a top rear perspective of the forward portion of the tunnel-boring machine with parts broken away and showing parts in the same operative position as shown in FIGS. 11 and 12.

If the shoes are in other than their substantially fully contracted relationship in which their fore-and-aft edges are in abutment or nearly in abutment as shown in FIGS. 11, 12 and 13, both to provide tilting control for the anchor shoes and to exert pressure on them, chordal intershoe jacks 21 are provided bridging the slots 14 between the portions of adjacent anchor shoes aft of fulcrums 17. Such intershoe jacks connect adjacent anchor shoes. While only one intershoe jack 21 aft of fulcrums 17 between each two adjacent shoes is shown in FIGS. 4, 5 and 6, several such jacks may be provided in a row along each slot. The intershoe jacks 20 and 21 are attached to the anchor shoes by universal joints 22.

The pressure in the jacks 21 will be regulated to control the swinging of the aft portions of the anchor shoes and consequently their convergence aft from a location immediately aft of the rotary cutterhead 1, taking into consideration the superincumbent ground pressure acting on the anchor shoes in any selected swung position. To accommodate a particular degree of convergence or constriction of the generally circular anchor shoe configuration, the pressure exerted by the jacks 20 and 21 must be sufficient to enable the anchor shoes on which they act to balance the superincumbent ground pressure exerted on them at that degree of convergence.

Figure 8:
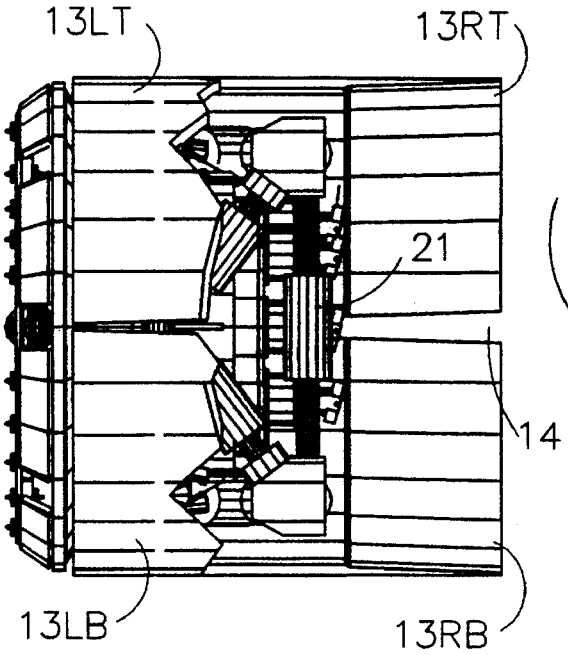
FIG. 8 is a side elevation of the forward portion of the tunnel-boring machine having parts broken away and showing parts in one operative position.
Figure 9:
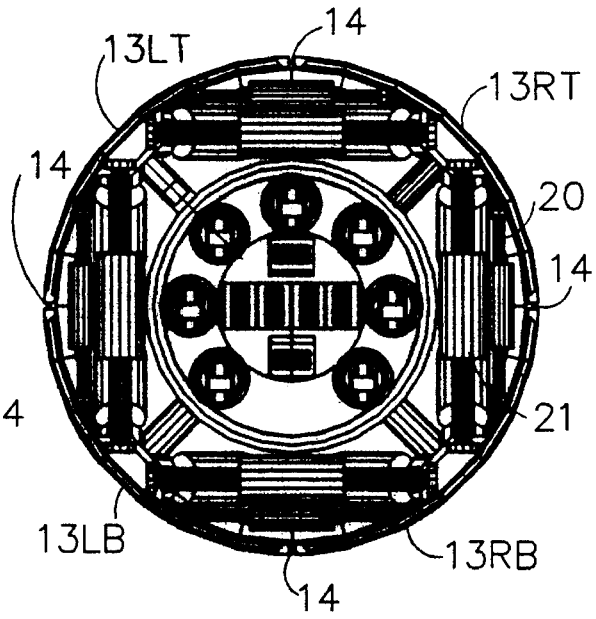
FIG. 9 is a rear elevation of the forward portion of the tunnel-boring machine showing parts in the same position as shown in FIG. 8.
Figure 10:
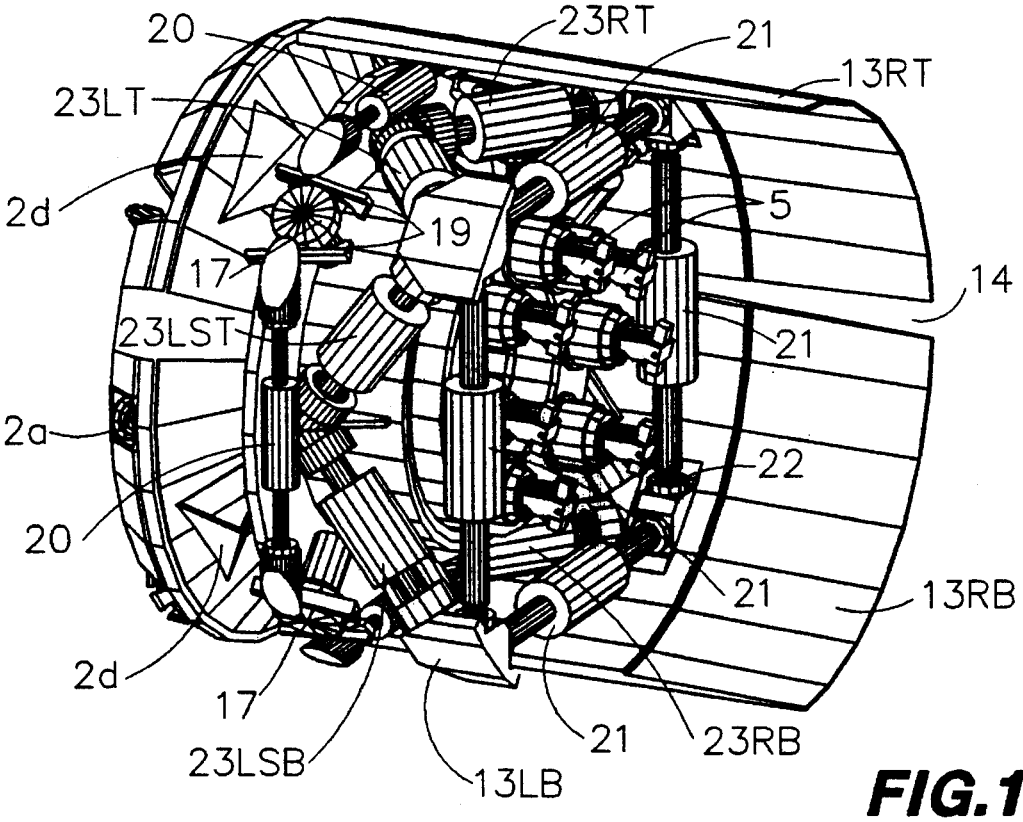
FIG. 10 is a top rear perspective of the forward portion of the tunnel-boring machine having parts broken away and showing parts in the same position as shown in FIGS. 8 and 9.

In the construction of the tunnel-boring machine where the anchor shoes can tilt, FIGS. 8, 9 and 10 show the anchor shoes 13LT, 13RT, 13LB and 13RB in their fully expanded open-slot relationship in which the cylindrically arcuate anchor shoes cooperatively form a cylindrical configuration and the girth of the anchor shoe configuration is constant fore-and-aft from leading end to trailing end. In such relationship, as shown best in FIGS. 8 and 10, the slots 14 flare rearwardly. By reducing the jack pressure the anchor shoes may tilt about their fulcrums 17 so that their aft portions swing inwardly to the closed-slot positions shown in FIGS. 11, 12 and 13, where the width of the slots 14 is uniform or the inward swinging of the anchor shoes is sufficient to bring their fore-and-aft edges into abutment. The tilting of the anchor shoes to any relationship between these two extreme relationships can be effected by appropriately altering the hydraulic pressure in jacks 20 and 21. In operation, substantial pressure will always be maintained in intershoe jacks 20 and 21 to provide the pressure necessary to react against the superincumbent ground pressure on the anchor shoes at a value sufficient to maintain such anchor shoes in their desired tilted positions.

As the anchor shoes are tilted about their fulcrums 17 from their positions shown in FIGS. 8, 9 and 10 to their positions shown in FIGS. 11, 12 and 13, the generally circular configuration will be progressively constricted so that the girth of the aft portion of the generally circular anchor shoe configuration aft will be less than its fore girth as shown in FIGS. 9 and 12.

The tunnel-boring machine of the present invention has the capability of advancing the cutterhead continuously like the tunnel-boring machine disclosed in U.S. Pat. No. 4,915,453. For this purpose, the rotary cutterhead may be inched forward continuously by the application to it of continual forward thrust reacting from the anchor shoes. It is not necessary that the mechanism for providing such forward thrust be used to move the cutterhead forward continuously, however. Also control of the rolling tendency of the machine resulting from rotation of the cutterhead can be effected as described in said U.S. Pat. No. 4,915,453 at column 17, lines 13 to 26 and in U.S. Pat. No. 5,005,911 at column 16, lines 55 to 68.

Like the thrusting mechanism shown in these U.S. patents, the thrusting mechanism of the present tunnel-boring machine includes double-acting jack bipods reacting between the anchor shoes and the mounting ring 4 for the cutterhead, one jack bipod for each anchor shoe. When there are four anchor shoes, four hydraulic jack bipods are arranged to connect such anchor shoes to four circumferentially equally spaced positions on the cutterhead mounting ring 4. Thus, as shown in FIGS. 4, 5, 6 and 7, the right bottom anchor shoe 13RB has a jack bipod with it apex connected to the circumferentially central portion of the anchor shoe as shown in FIG. 5 including a right bottom double-acting jack 23RB inclined forward and to the left and a right side lower double-acting jack 23RSB inclined forward and upward. The forward end of the jack 23RB is connected to the central bottom of the cutterhead mounting ring 4 as shown in FIGS. 4 and 5. The forward end of the right side lower jack 23RSB is connected to the right center of the cutterhead mounting ring 4 as shown in FIG. 7.

Correspondingly, a jack bipod including forwardly diverging double-acting hydraulic jacks has the rearward ends of such jacks forming the apex of the bipod connected to the circumferentially central portion of the left bottom anchor shoe 13LB. The left bottom jack 23LB shown in FIGS. 4, 5 and 7 is inclined forward and to the right to the bottom central portion of the cutterhead mounting ring 4 as shown in FIGS. 4 and 5. The left side lower jack 23LSB shown in FIGS. 7 and 10 is inclined upwardly from the circumferentially central portion of the anchor shoe 13LB to the central portion of the left side of the cutterhead mounting ring 4.

Correspondingly, the central portion of the left top anchor shoe 13LT is connected to the cutterhead mounting ring 4 by a hydraulic jack bipod, the double-acting jacks of which diverge forward. This bipod includes the higher left side jack 23LST shown in FIGS. 1, 2 and 10 which is inclined downwardly from the circumferentially central portion of the left top anchor shoe 13LT to the central portion of the left side of the cutterhead mounting ring 4. The other jack leg 23LT of this bipod shown in FIGS. 2, 7 and 10 constitutes the left top jack inclined from the central portion of the left top anchor shoe 13LT to the right to the central portion of the top of the cutterhead mounting ring 4.

Correspondingly, the jack bipod interengaged between the central portion of the right top anchor shoe 13RT and the cutterhead mounting ring 4 includes the right top double-acting jack 23RT shown in FIGS. 2, 6, 7 and 10 as being inclined from the central portion of the anchor shoe 13RT to the left to the top central portion of the cutterhead mounting ring 4 and the right side higher double-acting jack 23RST which is inclined from the central portion of the anchor shoe 13RT forward and downward to the central portion of the right side of the cutterhead mounting ring 4 as shown in FIGS. 2, 6 and 7.

To make the construction of the tunnel-boring machine more compact fore-and-aft, no annular shield is provided between the rotary cutterhead and the anchor shoes as provided in the tunnel-boring machine shown in U.S. Pat. No. 4,915,453 and U.S. Pat. No. 5,005,911, but instead the leading edges of the anchor shoes are always located quite close to the rotary cutterhead although the anchor shoes can be slid fore-and-aft in the operation of advancing the cutterhead of the tunnel-boring machine. The incremental sliding of the anchor shoes relative to the cutterhead mounting ring 4 and cutterhead 1 will alter the gap between the anchor shoes and the cutterhead.

In sliding each of the anchor shoes 13LT, 13RT, 13LB and 13RB forward relative to the fulcrum 17 bearing on it, to the cutterhead mounting ring 4 and to the cutterhead, it is necessary to contract the jacks of the bipod connected to such anchor shoe. All the bipods of all the anchor shoes will not be subjected to contracting pressure simultaneously, however, during normal boring operation of the machine although all of the bipods can be subjected to extending pressure simultaneously. If it should be desired to retract the cutterhead from the tunnel face all the bipods could be contracted simultaneously while the anchor shoes are maintained firmly set against the ground by pressure in the intershoe jacks 20 and 21.

Figure 17:
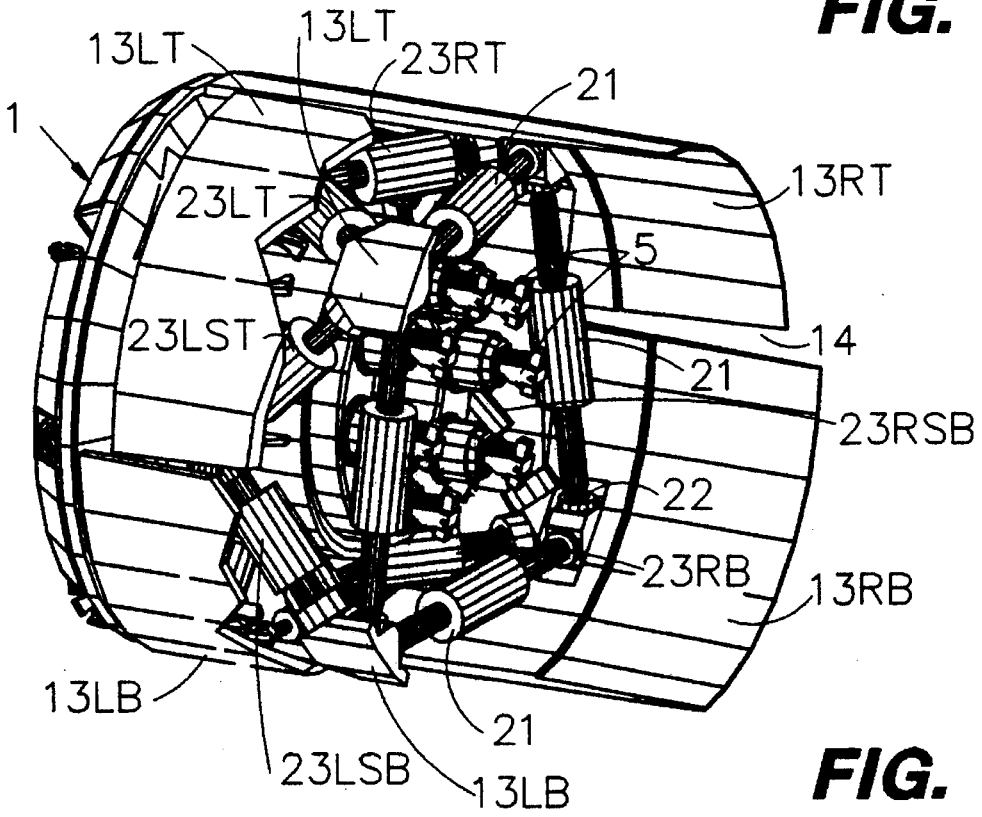
FIG. 17 is a top rear perspective of the forward portion of the tunnel-boring machine with parts broken away similar to FIG. 15 but showing parts in the same position as shown in FIG. 16.
Figure 18:
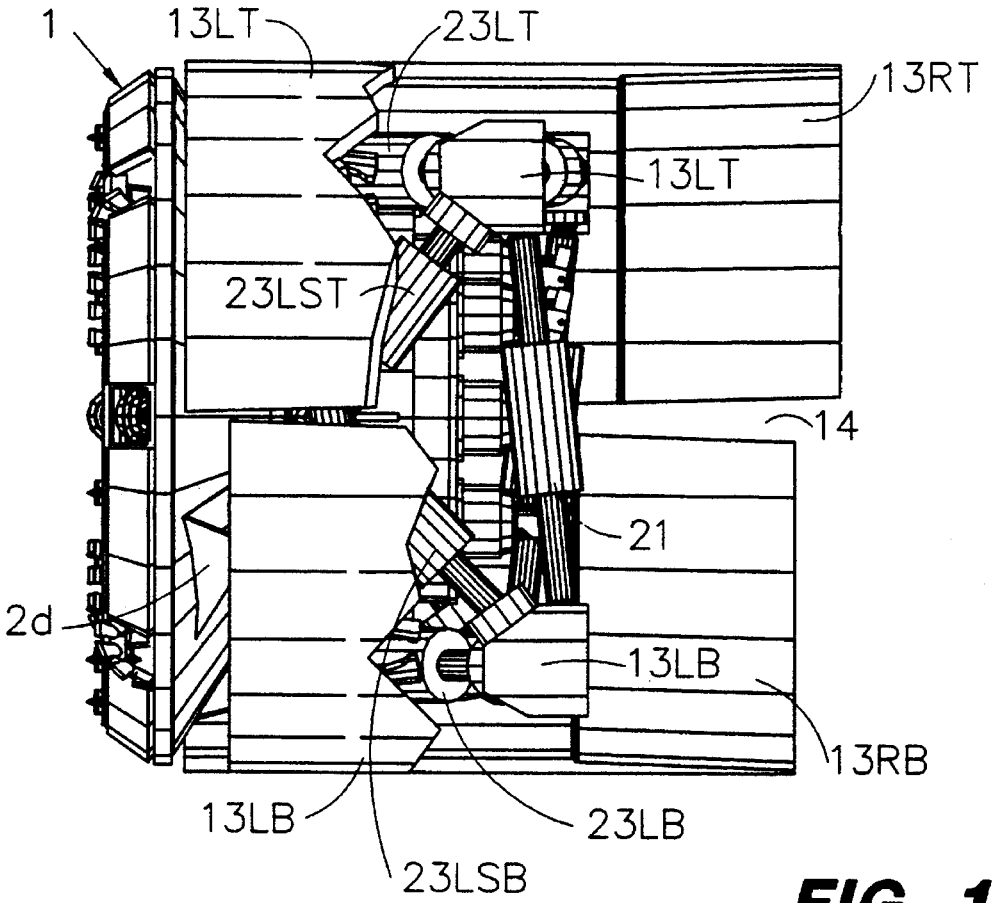
FIG. 18 is a side elevation of the forward portion of the tunnel-boring machine having parts broken away and showing parts in still a different operative position.
Figure 19:
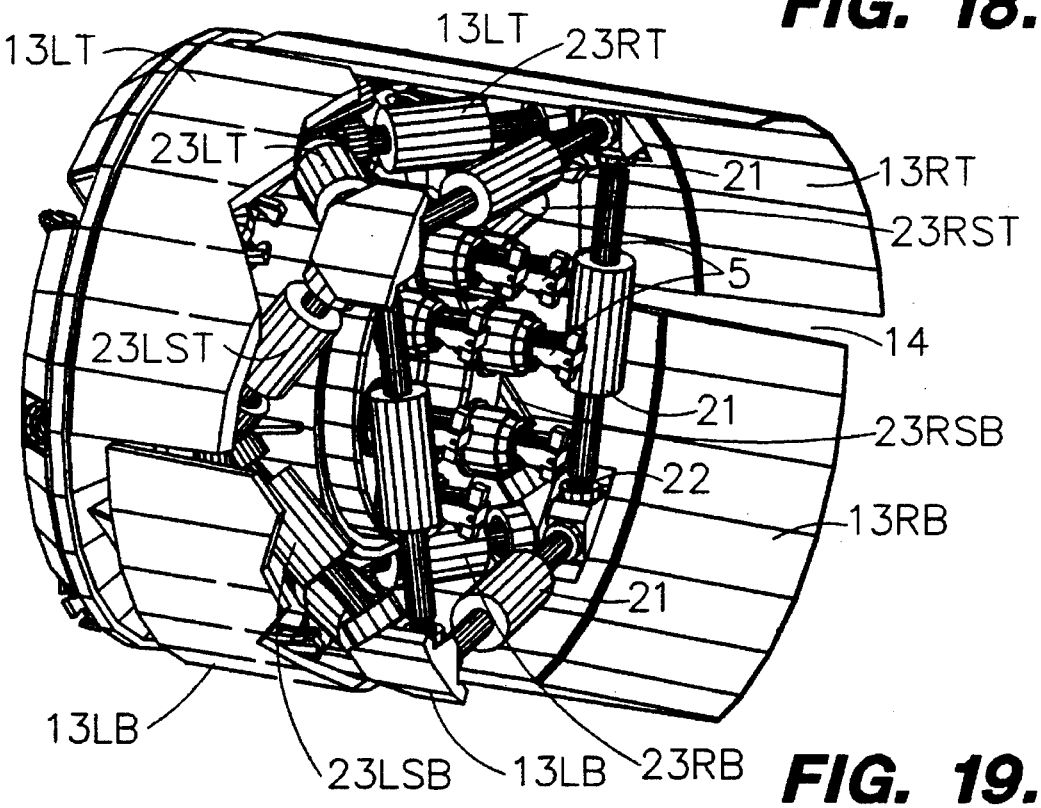
FIG. 19 is a top rear perspective of the forward portion of the tunnel-boring machine having parts broken away and showing parts in the same position as shown in FIG. 18.

In order to enable the anchor shoes to withstand the superincumbent ground pressure, considerable pressure must be maintained at all times in jacks 20 and 21. In fact, it is not necessary to reduce such pressure in these jacks much if any in order to slide one or two of the anchor shoes forward relative to their fulcrum 17, the cutterhead. The sequence of advancing the cutterhead mounting ring 4 and to the cutterhead and its mounting ring by the thrusting jack bipods is illustrated in FIGS. 17 to 19.

Figure 14:
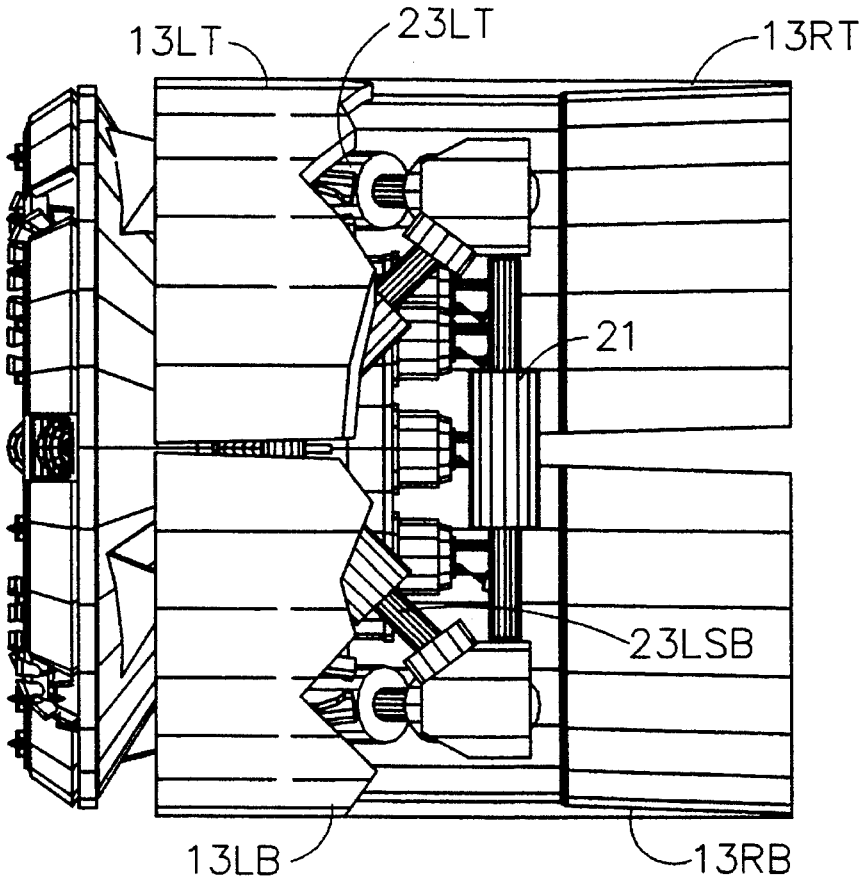
FIG. 14 is a side elevation of the forward portion of the tunnel-boring machine with parts broken away, showing parts in one operative position.
Figure 15:
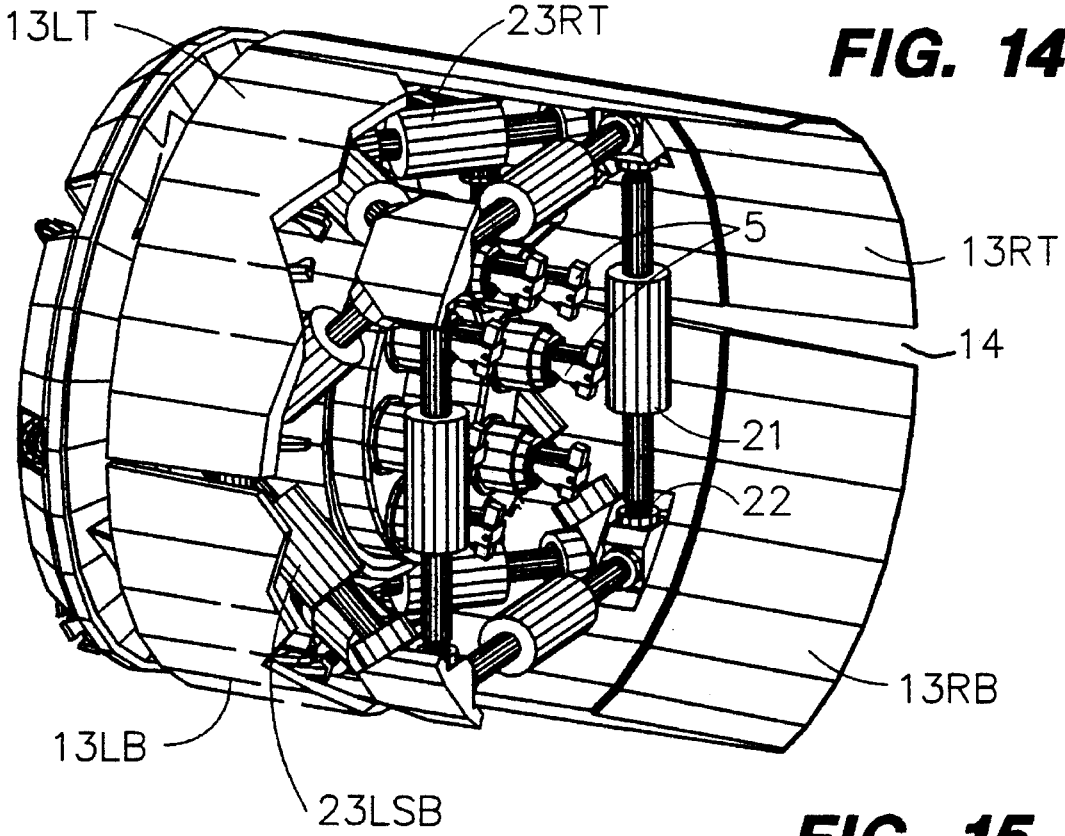
FIG. 15 is a top rear perspective of the forward portion of the tunnel-boring machine with parts broken away and showing parts in the same position as shown in FIG. 14.

In FIGS. 14, and 15, all of the anchor shoes are shown in their most rearward relationship to the cutterhead 1 which they would occupy at the end of a forward thrusting operation of the cutterhead if the cutterhead were not being advanced continuously. As shown, the leading edges of the anchor shoes are spaced rearwardly from the cutterhead to leave an annular gap which represents the amount of advance of the cutterhead during the last boring operation, assuming that none of the anchor shoes has been advanced during such boring operation. All of the fulcrums 17 would be in their positions closest to the leading edges of their anchor shoes as shown in FIG. 5. The jack bipods can be operated to shuffle the anchor shoes. The advance of the cutterhead may be from two inches to ten inches relative to the set anchor shoes, depending upon how heavy the going is and how self-sustaining the ground is between the cutterhead and the leading edges of the anchor shoes.

Considering first the operation of the tunnel-boring machine where the cutterhead is not being advanced continuously, the anchor shoes may be advanced singly, or in pairs where there are four anchor shoes as illustrated in the drawings. Such advancing of the anchor shoes is effected by the jack bipods interconnecting the anchor shoes and the mounting ring 4 for the rotary cutterhead.

Extending force exerted by the bipods of the anchor shoes which are to remain stationary have radially outward force components because the connection of the bipod jacks to the cutterhead mounting ring 4 as shown in FIGS. 4 and 5 are closer to the longitudinal center of the tunnel-boring machine than are the connections of such jacks to the anchor shoes, which force components increase the pressure of the stationary anchor shoes against the ground. The bipods of the anchor shoe or anchor shoes to be advanced, on the contrary, are subjected to contracting pressure to exert an inward pulling force on such anchor shoe or anchor shoes. Such pulling force also has a horizontal vector component which would tend to retract the cutterhead rearwardly, but such force is not effective to move the cutterhead rearwardly because such rearward force vector components are balanced by the forward force vector components of the bipod jacks under extending pressure, which would tend to move the cutterhead mounting ring 4 and the cutterhead 1 forward. Because of the increased pressure of the anchor shoes against the ground corresponding to the jacks exerting extending pressure, such anchor shoes will not be moved rearward by the force of the extending jacks.

As state above, the pulling force produced by the bipod jacks subjected to contracting pressure has both an inward vector component and a forward vector acting on the shoes to which such bipod jacks are connected. Because of the inward force vector component the pressure on the ground by an anchor shoe connected to such a pulling jack bipod will be reduced sufficiently so that the forward force vector component acting on such anchor shoe can slide such anchor shoe forward relative to its foot or fulcrum 17 and cutterhead mounting ring 4 toward the cutterhead despite the portion of the weight of the tunnel-boring machine carried by such a lower fulcrum serving as a foot even though pressure is being maintained generally equally on all the anchor shoes by the intershoe jacks 20 and 21.

While at a given time a single anchor shoe can be advanced in this manner with the other anchor shoes of the generally circular anchor shoe configuration remaining stationary, it is preferred that more than one anchor shoe be advanced simultaneously. Where the configuration includes an even number of anchor shoes, such as four, as shown in the drawings, or six, the jack bipods of alternate or opposite anchor shoes can be subjected to extending pressure to push such anchor shoes more firmly against the ground, whereas the jack bipods connected to two other opposite anchor shoes, or two other alternate anchor shoes, can be subjected to contracting pressure so that the jacks of such bipods will exert a pull on such other opposite anchor shoes for reducing their pressure against the ground and advancing them relative to the set anchor shoes and the cutterhead. Thus if there are six anchor shoes in the circular configuration two opposite anchor shoes could be advanced simultaneously while the two opposite anchor shoes of each of the other two anchor shoe pairs remain stationary. Then the anchor shoes of one of such other two anchor shoe pairs could be advanced simultaneously while the other four anchor shoes remain stationary. Finally the two anchor shoes of the third pair of two opposite anchor shoes could be advanced while the other four already advanced anchor shoes remain stationary in their advanced positions.

Alternatively the jacks of the bipods connected to three alternate anchor shoes of the six anchor shoes could be subjected to extending pressure to maintain such anchor shoes set against the ground while the jacks of the bipods connected to the other three alternate anchor shoes are subjected to contracting pressure to advance such three shoes simultaneously. Then the jack pressure could be reversed to contract the jacks connected to the first three anchor shoes while the jacks connected to the second three anchor shoes are subjected to extending pressure to set against the ground the three already advanced anchor shoes while the first three anchor shoes are pulled forward to corresponding positions. Whether the rotary cutterhead is advanced continuously or intermittently, the anchor shoes inch forward relative to the rotary cutterhead in predetermined sequence.

Figure 16:
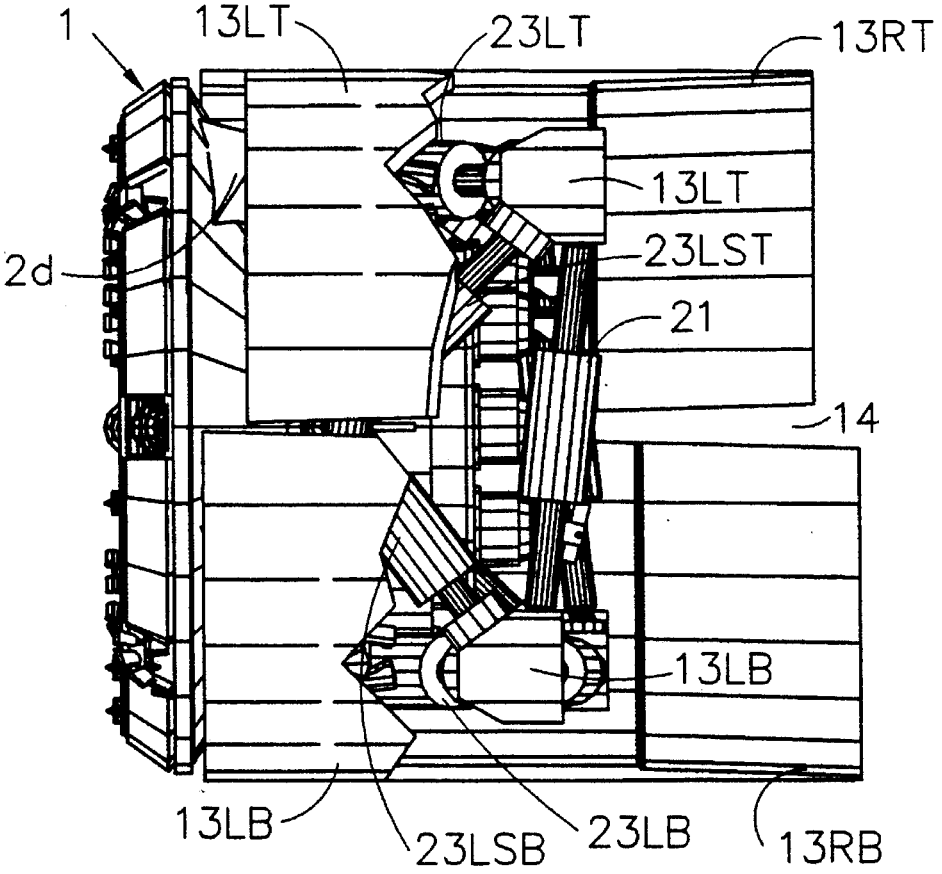
FIG. 16 is a side elevation of the forward portion of the tunnel-boring machine with parts broken away and showing parts in a different operative position.

In FIGS. 16 and 17 extending pressure in the jacks 23LT and 23LST connected between the upper left anchor shoe 13LT and the cutterhead mounting ring 4 has set the anchor shoe 13LT more firmly against the ground. Correspondingly, extending pressure in the circular bipod jacks 23RB and 23RSB connected between the lower right anchor shoe 13RB and the cutterhead mounting ring 4 has set this anchor shoe more firmly against the ground. At the same time, contracting pressure in the jacks 23LSB and 23LB of the bipod connected between the left bottom shoe 13LB and the mounting ring has reduced the pressure of the anchor shoe 13LB on the ground and slid it forward relative to its fulcrum foot 17, to the cutterhead mounting ring 4 and to the cutterhead 1 toward the cutterhead to the position shown in FIGS. 16 and 17despite weight of the tunnel-boring machine cutterhead mounting ring 4 and cutterhead carried by such fulcrum foot. At the same time, contracting pressure in jacks 23RT and 23RST of the bipod connected between the upper right anchor shoe 13RT and the mounting ring 4 of the cutterhead reduces the pressure of this anchor shoe against the ground and slides it forward relative to its fulcrum 17, to the cutterhead mounting ring 4 and to the cutterhead 1 toward the cutterhead to the position shown in FIGS. 16 and 17.

An alternative type of operation is illustrated in FIGS. 18 and 19, in which extending pressure in the jacks 23LSB and 23LB of the bipod connecting the left bottom anchor shoe 13LB and the cutterhead mounting ring has set this anchor shoe more firmly against the ground. The forward force component of such extending pressure acting on the cutterhead mounting ring 4 will slide the foot 17 of the bottom anchor shoe 13LB along such shoe to a position like that shown in FIG. 5 despite weight of the cutterhead mounting, cutterhead and associated mechanism carried by such foot pressing it against the shoe. Simultaneously extending pressure in the jacks 23RT and 23RST of the bipod connecting the right top anchor shoe 13RT to the mounting ring for the cutterhead has set this anchor shoe more firmly against the ground and the forward force component of the force of the jacks acting on the cutterhead mounting ring 4 will assist in advancing the cutterhead.

Simultaneously contracting pressure in the jacks 23LT and 23LST of the bipod connecting the left top anchor shoe 13LT to the cutterhead mounting ring has reduced the outward pressure of such shoe against the ground and provided a forward force vector to slide such shoe forward relative to its fulcrum 17, to the cutterhead mounting ring 4, the cutterhead and to the anchor shoes 13RT and 13LB to the position shown in FIGS. 18 and 19. Similarly, extending pressure in the jacks 23RB and 23RSB of the bipod connecting the lower right anchor shoe 13RB to the cutterhead mounting ring has reduced the pressure of that shoe against the ground and provided a forward vector force to slide it forward under its foot 17, to the position shown in FIGS. 4, 18 and 19 despite pressure of the foot 17 on such anchor shoe 13RB resulting from weight of the cutterhead mounting ring 4, cutterhead and associated parts carried by such foot through its jack 15, 16 mounted on the cutterhead mounting ring 4.

In the operation described in connection with FIGS. 16, 17, 18 and 19, if the cutterhead is being advanced intermittently, after one pair of opposite anchor shoes has been moved forwardly as described so that their fulcrums 17 are in the position shown in FIG. 4 the extending pressure in the jacks of the bipods connected to such anchor shoes would be increased to set those anchor shoes more firmly against the ground, and contracting pressure in the jacks of the bipods connected to the other anchor shoes would slide them forward into positions corresponding to the first anchor shoes advanced so that the anchor shoes would be in the positions shown in FIG. 8 or FIG. 11 and all the fulcrums 17 would be in the position shown in FIG. 4. Extending pressure could then be supplied to all of the bipod jacks simultaneously to set them more firmly against the ground and simultaneously exert an advancing force on the cutterhead mounting ring 4to advance the cutterhead to the position shown in FIG. 14 in which all the fulcrums 17 would be in the position of FIG. 5.

If it were desired to advance the cutterhead continuously instead of intermittently, extending pressure in the jacks of the bipods of opposite anchor shoes would set those anchor shoes more firmly against the ground and push the cutterhead forward accompanied by forward sliding of their fulcrums or feet 17 on such anchor shoes while at the same time contracting pressure in the jacks of the bipods connected to other opposite anchor shoes would slide those anchor shoes forward during relative to their fulcrums or feet 17, advance of the cutterhead until their fulcrums or feet have reached the position shown in FIG. 4 after which such anchor shoes would be slid forward in synchronism with the cutterhead until the fulcrums or feet 17 of the anchor shoes set against the ground have reached or approached the position of FIG. 5. The operation could then be reversed so that the jacks of the bipods connected to the forward anchor shoes would be extended to set those anchor shoes more firmly against the ground and advance the cutterhead while the jacks of the bipods connected to the trailing anchor shoes would be contracted to slide such trailing anchor shoes forward relative to their fulcrums or feet, to the cutterhead mounting ring 4 and to the cutterhead beyond the set anchor shoes, and this operation could be repeated.

Throughout this operation fluid under pressure would be supplied to all of the jacks 20 and 21 tending to expand them to increase the pressure of the anchor shoes against the ground by tending to increase the width of the slots 14 between the adjacent fore-and-aft edges of adjacent anchor shoes.

As seen best in FIG. 2, the chordal jacks 20 and 21 which connect adjacent anchor shoes do not extend inwardly appreciably beyond the jacks of the bipods connecting the anchor shoes to the cutterhead mounting ring 4. Consequently, the interior of the tunnel-boring machine is much less cluttered than where intershoe jacks connect anchor shoes at opposite sides of the tunnel-boring machine. More space is therefore provided for the tow beam 11 and the muck conveyor 10, and space is provided at opposite sides of such tow beam and muck conveyor for workers to walk through the tunnel-boring machine, such as for inspecting or servicing components of the machine including the cutterhead 1, the drive motors 5, the fulcrums 15, 16, 17, the hydraulic jacks 20 and 21 and jacks of the bipods.

I claim:

1. In a tunnel-boring machine having a forward rotary cutterhead, several anchor shoes elongated fore and aft and arranged in a generally circular configuration aft of the cutterhead, and thrust means connecting the anchor shoes and the cutterhead for exerting thrust to advance the cutterhead, the improvement comprising pressure-exerting means engaged between adjacent anchor shoes for exerting pressure resisting contraction of the generally circular configuration of anchor shoes and shoe-supporting means for the anchor shoes enabling the shoes to tilt fore and aft and including individual fulcrum means for each anchor shoe near the leading end of each anchor shoe.

2. In a tunnel-boring machine having a forward rotary cutterhead, several anchor shoes elongated fore and aft and arranged in a generally circular configuration aft of the cutterhead with slots between such shoes, and thrust means connecting the anchor shoes and the cutterhead for exerting thrust to advance the cutterhead, the improvement comprising shoe-supporting means for the anchor shoes enabling the shoes to tilt fore and aft, and pressure-exerting means engaged between adjacent anchor shoes for exerting pressure resisting contraction of the generally circular configuration of anchor shoes resulting from reduction in the width of the slots between the anchor shoes, at lease one of the anchor shoes being truncated by relieving at least one of its fore-and-aft edges.

3. In a tunnel-boring machine having a forward rotary cutterhead, several anchor shoes arranged in a generally circular configuration aft of the cutterhead with slots between such shoes and floating with respect to the rotary cutterhead, thrust means connecting the anchor shoes and the cutterhead for exerting thrust to advance the cutterhead, and thrust means for shifting the anchor shoes forward toward the rotary cutterhead, the improvement comprising pressure-exerting means engaged between adjacent anchor shoes for exerting pressure resisting contraction of the generally circular configuration of anchor shoes resulting from reduction in the width of the slots between the anchor shoes, and centering means for centering each anchor shoe during its forward movement as it approaches the rotary cutterhead.

4. In the machine defined in claim 3, the centering means including a projection fixed in position fore and aft relative to the rotary cutterhead and rails carried by an anchor shoe flaring forward, straddling said projection and engageable with said projection as the anchor shoe is moved forward for centering such anchor shoe relative to said projection.

5. In a tunnel-boring machine having a forward rotary cutterhead, a mounting ring for the rotary cutterhead, several anchor shoes arranged in a generally circular configuration aft of the cutterhead with slots between such shoes, and thrust means connecting the anchor shoes to the cutterhead mounting ring to advance the cutterhead, the improvement comprising pressure-exerting means engaged between adjacent anchor shoes for exerting pressure resisting contraction of the generally circular configuration of anchor shoes resulting from reduction in the width of the slots between the anchor shoes, said pressure-exerting means extending inwardly at least not appreciably beyond the thrust means.

6. In the machine defined in claim 5, the thrust means including hydraulic jacks and the pressure-exerting means including chordal jacks bridging the slots between and interconnecting adjacent anchor shoes.

7. In a tunnel-boring machine including several anchor shoes elongated fore and aft arranged in a generally circular configuration, the generally circular anchor shoe configuration having a smaller girth aft than the fore girth of the generally circular anchor shoe configuration, and means supporting the anchor shoes for tilting fore-and-aft to alter the girth of the generally circular anchor shoe configuration, the improvement comprising the supporting means including means for producing resistance to tilting of the anchor shoes.

8. In the machine defined in claim 7, the means for producing resistance to tilting of the anchor shoes of the circular anchor shoe configuration counteracting ground pressure on the aft portions of the anchor shoes.

9. A process of operating a tunnel-boring machine including a generally circular configuration of anchor shoes with fore-and-aft slots between adjacent anchor shoes, which comprises exerting an inward pull on one anchor shoe of the generally circular anchor shoe configuration while simultaneously exerting an outward push on an adjacent anchor shoe of the generally circular anchor shoe configuration and simultaneously applying pressure on the generally circular anchor shoe configuration for resisting narrowing of the fore-and-aft slots between adjacent anchor shoes resulting from superincumbent ground pressure on the anchor shoes.

10. The process defined in claim 9, including applying to an anchor shoe an inward pull which has a forward vector component for effecting forward sliding of such anchor shoe.

11. The process defined in claim 9, in which the generally circular anchor shoe configuration includes an even number of anchor shoes, and applying a pulling force to alternate anchor shoes in the anchor shoe configuration while simultaneously applying a pushing force to the other alternate anchor shoes in the anchor shoe configuration.

12. The process defined in claim 11, including each pulling force having a forward vector component for sliding forward the anchor shoes to which the pulling force is applied relative to the anchor shoes to which the pushing force is applied.

13. The process defined in claim 9, in which the generally circular anchor shoe configuration includes an even number of anchor shoes, and applying a pulling force to opposite anchor shoes of the configuration and simultaneously applying a pushing force to other opposite anchor shoes of the configuration.

14. In a tunnel-boring machine having a forward rotary cutterhead, cutterhead mounting means mounting the cutterhead, several anchor shoes arranged in a generally circular configuration aft of the cutterhead, and thrust means connecting the anchor shoes and the cutterhead mounting means for exerting thrust to advance the cutterhead, the improvement comprising supporting means supporting at least a portion of the weight of the cutterhead mounting means and cutterhead on at least one of the anchor shoes and said supporting means being slidable fore-and-aft relative to such anchor shoe.

15. In the machine defined in claim 14, the supporting means including afoot carried by the cutterhead mounting means and bearing on an anchor shoe.

16. In the machine defined in claim 14, the anchor shoes including two lower anchor shoes beneath the cutterhead mounting means, and the supporting means bearing generally equally on said two lower anchor shoes.

17. In the machine defined in claim 14, the supporting means including projections carried by and extending generally radially outward from the cutterhead mounting means engageable with the forward portions of the anchor shoes, respectively.

18. In the machine defined in claim 17, the supporting means projections including upper projections at least partially supporting upper anchor shoes from the cutterhead mounting means and lower projections at least partially supporting the cutterhead mounting means on lower anchor shoes.

19. In the machine defined in claim 17, each projection including a hydraulic jack.

20. In the machine defined in claim 17, each projection including a fulcrum engageable with an anchor shoe about which the anchor shoe can tilt.

21. In the machine defined in claim 17, each projection bearing slidably against an anchor shoe for sliding fore-and-aft relative to such anchor shoe.

22. In the machine defined in claim 14, the anchor shoe configuration including four anchor shoes arranged symmetrically circumferentially, including two upper anchor shoes and two lower anchor shoes.

23. In the machine defined in claim 14, the anchor shoes being located immediately aft of the rotary cutterhead, and means supporting at least one of the anchor shoes for tilting fore and aft.

24. A process of operating a tunnel-boring machine having a forward rotary cutterhead and cutterhead mounting means immediately aft of the cutterhead, which comprises providing a generally circular configuration of separate and individual anchor shoes immediately rearward of the rotary cutterhead, at least partially supporting the cutterhead mounting means from at least one of the lower anchor shoes, and sliding such lower anchor shoe fore and aft relative to the cutterhead mounting means.

25. The process defined in claim 24, in which the generally circular configuration of anchor shoes includes two lower anchor shoes beneath the cutterhead mounting means, and supporting the cutterhead mounting means on such lower anchor shoes for sliding fore and aft relative to such lower anchor shoes.

26. The process defined in claim 25, including sliding the two lower anchor shoes independently of each other relative to the cutterhead mounting means.

27. The process defined in claim 25, including sliding the cutterhead mounting means forward relative to one of the two lower anchor shoes and sliding the other of such two lower anchor shoes forward relative to the cutterhead mounting means.

28. The process defined in claim 25, including sliding the cutterhead mounting means forward relative to one of the two lower anchor shoes while simultaneously sliding the other of such two lower anchor shoes forward relative to the cutterhead mounting means.

29. A process of operating a tunnel-boring machine which comprises exerting superincumbent ground pressure on a generally circular configuration of anchor shoes elongated fore-and-aft, which anchor shoes are tiltable fore and aft, and exerting outward pressure on aft portions of the shoes in opposition to the superincumbent ground pressure on the anchor shoes and thereby controlling the inward movement of the aft portions of the anchor shoes effected by such superincumbent ground pressure.

30. A process of operating a tunnel-boring machine which comprises exerting outward pressure on the aft portion of a generally circular configuration of anchor shoes elongated fore-and-aft and tiltable fore and aft for resisting constriction of the aft portion of such anchor shoe configuration resulting from superincumbent ground pressure on the anchor shoes and restricting such outward pressure to enable the aft portion of the anchor shoe configuration to be constricted by the superincumbent ground pressure to a limited degree.

31. A process of operating a tunnel-boring machine having a generally circular configuration of anchor shoes which comprises exerting an inward pull on one anchor shoe of the generally circular anchor shoe configuration while simultaneously exerting an outward push on an adjacent anchor shoe of the generally circular anchor shoe configuration and simultaneously applying pressure for resisting constriction of the generally circular configuration of anchor shoes.

32. The process defined in claim 31, including applying to an anchor shoe an inward pull which has a forward vector component for effecting forward sliding of such anchor shoe.

33. The process defined in claim 31, in which the generally circular anchor shoe configuration includes an even number of anchor shoes, and applying a pulling force to alternate anchor shoes in the anchor shoe configuration while simultaneously applying a pushing force to the other alternate anchor shoes in the anchor shoe configuration.

34. The process defined in claim 33, including each pulling force having a forward vector component for sliding forward the anchor shoes to which the pulling force is applied relative to the anchor shoes to which the pushing force is applied.

35. The process defined in claim 31, in which the generally circular anchor shoe configuration includes an even number of anchor shoes, and applying a pulling force to opposite anchor shoes of the configuration and simultaneously applying a pushing force to other opposite anchor shoes of the configuration.

36. In a tunnel-boring machine having a forward rotary cutterhead, several anchor shoes elongated fore and aft and arranged in a generally circular configuration aft of the cutterhead, and thrust means for moving adjacent anchor shoes relatively longitudinally, the improvement comprising chordal jacks connecting such adjacent anchor shoes for exerting on them a force directed generally circumferentially of the circular anchor shoe configuration and connected flexibly to such adjacent anchor shoes for enabling such adjacent anchor shoes to be moved relatively longitudinally.

* * * * *